US006446274B1

(12) United States Patent
Horiuchi

(10) Patent No.: US 6,446,274 B1
(45) Date of Patent: Sep. 10, 2002

(54) URINE POT

(76) Inventor: Kimiyo Horiuchi, 2-6-2 2B Gotokuji Setagaya, Tokyo (JP)

( * ) Notice: Subject to any disclaimer, the term of this patent is extended or adjusted under 35 U.S.C. 154(b) by 0 days.

(21) Appl. No.: 08/888,744

(22) Filed: Jul. 7, 1997

(30) Foreign Application Priority Data

Jul. 4, 1996 (JP) ..... 8-007791

(51) Int. Cl.[7] ..... A47K 11/12
(52) U.S. Cl. ..... 4/144.3
(58) Field of Search ..... 4/144.3

(56) References Cited

U.S. PATENT DOCUMENTS 137,214 A * 3/1873 Knight et al. ..... 4/144.3
703,131 A * 6/1902 Jaenel ..... 4/144.3
4,050,103 A * 9/1977 Nakao et al. ..... 4/144.3 X
4,091,476 A * 5/1978 DeBurgh ..... 4/144.3

* cited by examiner

*Primary Examiner*—Robert M. Fetsuga
(74) *Attorney, Agent, or Firm*—David J. Archer

(57) ABSTRACT

A urine pot capable of reducing accidental leakage of urine once received therein and avoiding emission of noise of urine injection, which comprises a combination of a urine pot body, in which urine is received and which has a neck, with an insertion funnel for male or with an insertion funnel for female, in which both of these funnels have a portion to be inserted into the neck of the pot body and an elongated discharge spout extending downwards, said insertion funnel being adapted to be coupled tightly with the pot body upon insertion of the funnel into the neck of the pot body with its spout end being located near the bottom of the pot body, so as to be kept immersed within the urine layer in the pot, and the top of the insertion funnel being desined to be adapted for use either for male or for female.

1 Claim, 1 Drawing Sheet

URINE POT

FIELD OF THE INVENTION

The present invention relates to an improved urine pot or urinal.

BACKGROUND OF THE INVENTION

Conventional urine pots used, for instance, by elderly male and female people at bedtime, are made of glass or thermosetting resin and have a simple structure being fitted with only a simple lid on the top. Thus, urine once received in such a urine pot may spill out or even spill out of the pot when the pot is handled roughly or carelessly. It is disadvantageous also, that a loud unpleasant sound of jetting urine stream is given off to the ambient nocturnal still upon the use of the pot.

SUMMARY OF THE INVENTION

The object of the present invention is to obviate the disadvatages of conventional urine pots mentioned above by providing an improved urine pot.

Thus, the urine pot according to the present invention comprises a combination of a urine pot body, in which urine is received and which has a neck, with an insertion funnel for male or with an insertion funnel for female, wnerein both of these funnels have a portion to be inserted into the neck of the pot body and an elongated discharge spout extending downwards, said insertion funnel being adapted to be coupled tightly with the pot body upon insertion of the funnel into the neck of the pot body with its spout end being located near the bottom of the pot body and the top of the insertion funnel being desined to be adapted for use either for male or for female.

BRIEF DESCRIPTION OF THE DRAWINGS

The essential structure of the urine pot according to the present invention is depicted in the accompanying drawings, in which.

DETAILED DESCRIPTION OF THE INVENTION

Figure 1:
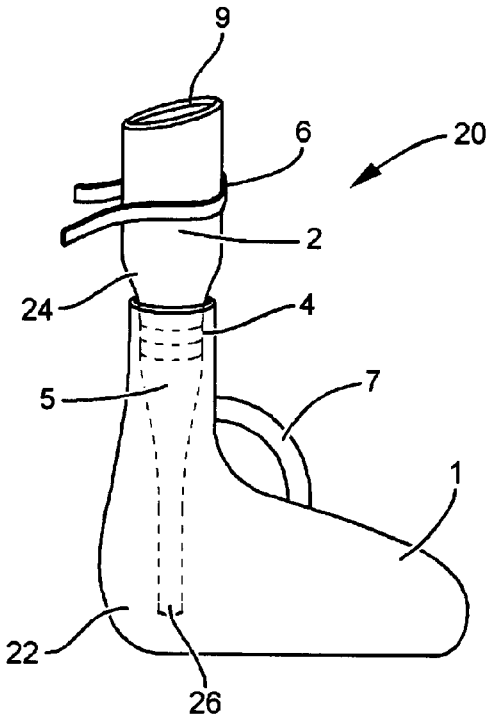
FIG. 1 shows the essential construction of the urine pot assembled with an insertion funnel for male in a perspective view.

FIG. 1 is a side elevational view of a urine pot according to the present invention, As shown in FIG. 1, the urine pot generally designated 20 includes a urine pot body 1, in which urine is received The urine pot body 1 has a neck 4 and a bottom 22 and an insertion funnel 2 for use thereof by a male. The insertion funnel 2 includes a top portion 24 to be inserted into the neck 4 of the urine pot body 1. An elongated discharge spout 5 extends downwards from the top portion 24, the elongated discharge spout 5 having a spout end 26, the insertion funnel 2 being removably insertable through the neck 4 of the urine pot body 1 into the urine pot body 1. The arrangement is such that when the urine pot 20 is to be used by a male, the spout end 26 of the insertion funnel 2 is inserted through the neck 4 of the urine pot body 1 so that the top portion 24 of the insertion funnel 2 engages and tightly fits within the neck 4 of the urine pot body 1 and so that the spout end 26 of the elongated discharge spout 5 is disposed adjacent to the bottom 22 of the urine pot body 1. The arrangement is such that when a jetting flow of urine flows through the insertion funnel 2 from the top portion 24 to the spout end 26, noise from the jetting flow is inhibited due to the spout end 26 being disposed adjacent to the bottom 22 of the urine pot body 1, the noise being further inhibited when the spout end 26 of the insertion funnel 2 becomes disposed below a surface of urine contained within the urine pot body 1.

Figure 2:
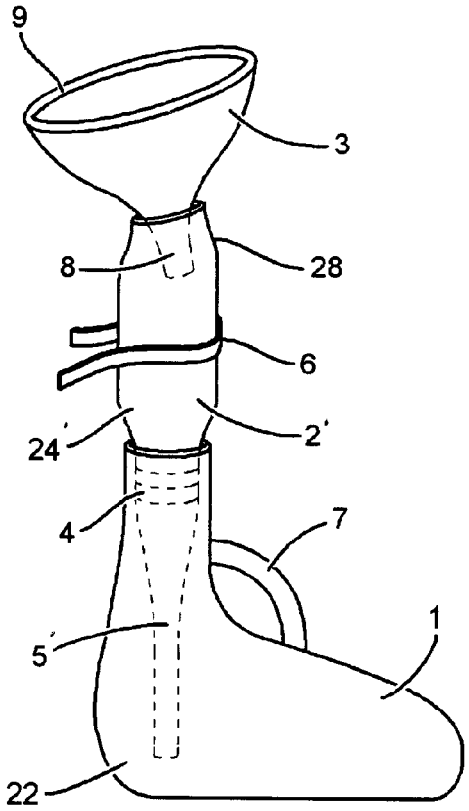
FIG. 2 shows the essential construction of the urine pot assembled with an insertion funnel for female coupled with an attachment for female in a perspective view.

FIG. 2 is a side elevational view of the urine pot 20 shown in FIG. 1. However, as shown in FIG. 2, a further insertion flannel 2' is selectively interchangeable with the insertion funnel 2 shown in FIG. 1. The further insertion funnel 2' is for use thereof by a female. The further insertion funnel 2' includes a further top portion 24' to be inserted into the neck 4 of the urine pot body 1, A further elongated discharge spout 5' extends downwards from the further top portion 24', the further elongated discharge spout 5' having a further spout end 26', The further insertion funnel 2' is removably insertable through the neck 4 of the urine pot body 1 into the urine pot body 1 such that when the urine pot 20 is to be used by a female, the further spout end 26' of the further insertion funnel 2' is inserted through the neck 4 of the urine pot body 1 so that the further top portion 24' of the further insertion fennel 2' engages and tightly fits within the neck 4 of the urine pot body 1 and so that the further spout end 26' of the further elongated discharge spout 5' is disposed adjacent to the bottom 22 of the urine pot body 1. The arrangement is such that when a further jetting flow of urine flows through the further insertion funnel 2' from the further top portion 24' to the further spout end 26'. noise from the further jetting flow is inhibited due to the further spout end 26' being disposed adjacent to the bottom 22 of the urine pot body 1, the noise being further inhibited when the further spout end 26' of the further insertion funnel 2' becomes disposed below a surface of urine contained within the urine pot body 1.

More specifically, as shown in FIG. 2, the urine pot 20 further includes a fennel shaped attachment 3, the attachment 3 having a top periphery 9 and a coupling or socket 28, the coupling 28 of the attachment 3 coupling with the further top portion 24' of the further insertion funnel 2' for facilitating cleaning thereof.

Also, the urine pot body 1 is made of a rigid material and the insertion funnels 2 and 2' are made of a material exhibiting some resiliency for allowing a tight fit of the insertion funnels 2 and 2' with the mine pot body 1 upon insertion into the neck 4 of the urine pot body 1.

Figure 3:
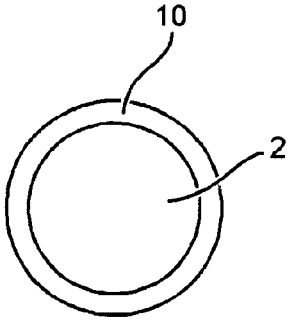
FIG. 3 is a top view of an embodiment of the insertion funnel for male and FIG. 4 is a top view of the attachment for female shown in FIG. 2.

FIG. 3 is a top plan view of the insertion funnel 2 shown in FIG. 1. As shown in FIG. 3, the top periphery 9 has a skin contacting layer 10 for lining the top periphery 9, the layer 10 being of a soft material.

Figure 4:
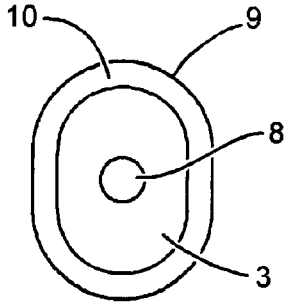

FIG. 4 is a top plan view of the attachment 3 shown in FIG. 2. As shown in FIG. 4, the urine pot 20 further includes a skin contacting layer 10 for lining the top periphery 9 of the attachment 3, the layer 10 being of a soft material.

As shown in FIG. 1, the urine pot 20 further includes a pressing element 6 made of a rigid material for pressing the top portion 24 above the neck 4 of the urine pot body 1 to assist a tight fit between the neck 4 and the top portion 24.

Explaining the essential construction of the urine pot according to the present invention with reference to the accompanying drawings, the urine pot comprises a urine pot body (1) and an insertion funnel (2) which is designed for use either for male or for female and which is to be coupled-with the pot body (1) by insertion thereof into the neck (4) of the pot body (1) with the spout end of the funnel being located near the bottom of the pot body (1).

The pot body (1) is made of a rigid material, such as a glass or a thermosetting resin and has a contracting neck (4) and a handing lug (7).

The insertion funnel (2) is made of a material which exhibits some resilience for achieving a tight fit with the neck (4) of the pot body upon insertion thereinto. Such a material may be a thermoplastic resin, such as polyethylene, polypropylene or the like, of which polyethylene is most preferable.

The insertion funnel (2) is designed so as to be adapted for insertion into the neck (4) of the pot body (1) and has a discharge spout (5) extending down from the portion of the funnel to be inserted into the neck (4) of the pot body (1) to a portion near the bottom of the of the pot body (1) in order to maintain the end of the spout (5) to be immersed within the urine layer once received, whereby emission of noise of injection of urine upon the use of the pot is avoided. For assisting tight fit of the pot body (1) with the insertion funnel (2) at the portion to be inserted into the neck of the pot body, the insertion funnel may be provided with screw thread at this portion as seen in FIGS. 1 and 2. The top portion of the insertion funnel should have a shape adapted for use eithe for male or for female.

Thus, the top of the insertion fennel (2) for male may have, in one embodiment, a shape adapted for use for male, such as shown in FIG. 1. The top of the insertion funnel (2') for female may, in one embodiment be formed into a socket (8) for receiving an an attachment (3) for use for female, as shown in FIG. 2. Alternatively, an adequately designed attachment for male can be attached to the top of a correspondingly designed insertion fennel. By constructing the urine pot from three parts, namely, an attachment (3), an insertion funnel (2) and a pot body (1), cleaning or washing of the urine pot becomes easy.

The attachment (3) is made preferably of a rigid material such as a glass or a thermosetting resin, so that coupling with the insertion funnel can easily be realized by making use of the resilient nature of the insertion funnel.

In one embodiment of the urine pot according to the present invention, the insertion funnel (2) or the attachment (3) is lined around the top periphery (9) to be fitted to the human skin with a layer of spongy rubber or foamed plastic (10) as shown in FIGS. C and D, in order to facilitate a tight fit and soft touch onto the skin.

In a further embodiment of the urine pot according to the present invention, a pressing element (6) made of a rigid material is incorporated, as shown in FIGS. 1 and 2, for pressing the insertion fennel outside to bulge the junction portion (at 4 or 8) to assist the tight fit at such potion.

The urine pot according to the present invention can reliably avoid eventual leakage or spilling of urine once received therein and, in addition, can eliminate emission of noise of urine injection, since the spout (5) of the insertion funnel (2) extends down to a portion near the bottom of the pot body (1) and the sput end is immersed in the urine layer and since the insertion funnel (2) is inserted into the neck (4) of the pot body (1) under a tight fit.

What is claimed is:

1. A urine pot comprising:

a urine pot body, in which urine is received, said urine pot body having a neck and a bottom;

an insertion funnel for use thereof by a male;

said insertion funnel including:

a top portion to be inserted into said neck of said urine pot body;

an elongated discharge spout extending downwards from said top portion, said elongated discharge spout having a spout end, said insertion funnel being removably insertable through said neck of said urine pot body into said urine pot body such that when said urine pot is to be used by a male, said spout end of said insertion funnel is inserted through said neck of said urine pot body so that said top portion of said insertion funnel engages and tightly fits within said neck of said urine pot body and so that said spout end of said elongated discharge spout is disposed adjacent to said bottom of said urine pot body, the arrangement being such that when a jetting flow of urine flows through said insertion funnel from said top portion to said spout end, noise from said jetting flow is inhibited due to said spout end being disposed adjacent to said bottom of said urine pot body, said noise being further inhibited when said spout end of said insertion funnel becomes disposed below a surface of urine contained within said urine pot body;

a further insertion fennel selectively interchangeable with said insertion funnel, said further insertion funnel being for use thereof by a female;

said further insertion funnel including:

a further top portion to be inserted into said neck of said urine pot body;

a further elongated discharge spout extending downwards from said further top portion, said further elongated discharge spout having a further spout end, said further insertion funnel being removably insertable through said neck of said urine pot body into said urine pot body such that when said urine pot is to be used by a female, said further spout end of said further insertion funnel is inserted through said neck of said urine pot body so that said further top portion of said further insertion funnel engages and tightly fits within said neck of said urine pot body and so that said further spout end of said further elongated discharge spout is disposed adjacent to said bottom of said urine pot body, the arrangement being such that when a further jetting flow of urine flows through said further insertion funnel from said further top portion to said further spout end, noise from said further jetting flow is inhibited due to said further spout end being disposed adjacent to said bottom of said urine pot body, said noise being further inhibited when said further spout end of said further insertion funnel becomes disposed below a surface of urine contained within said urine pot body;

said urine pot further including:

a funnel shaped attachment, said attachment having a top periphery and a socket, said socket of said attachment coupling with said further top portion of said further insertion funnel for facilitating cleaning thereof;

said urine pot body being made of a rigid material and said insertion funnels being made of a material exhibiting some resiliency for allowing a tight fit of said insertion funnels with said urine pot body upon insertion into said neck of said urine pot body; and a layer of spongy material for lining said top periphery of said attachment.

* * * * *